United States Patent [19]

Scordato et al.

[11] 4,349,109

[45] Sep. 14, 1982

[54] DISPOSABLE PIPETTE TIPS AND TRAYS THEREFOR

[75] Inventors: Emil A. Scordato, Eastchester; Hugh W. Pratt, Pelham Manor, both of N.Y.

[73] Assignee: Medical Laboratory Automation, Inc., Mount Vernon, N.Y.

[21] Appl. No.: 199,045

[22] Filed: Oct. 20, 1980

[51] Int. Cl.[3] ..... B65D 85/30; B65D 21/00

[52] U.S. Cl. ..... 206/562; 206/486; 206/503; 206/499

[58] Field of Search ..... 206/557, 562, 518, 515, 206/499, 223, 486, 503; 222/566, 567; 422/100; 73/425.4 R, 425.6

[56] References Cited

U.S. PATENT DOCUMENTS

| | | | |
|---|---|---|---|
| 3,281,898 | 11/1966 | Compton | 222/566 |
| 3,853,217 | 12/1974 | Scordato et al. | 206/557 |
| 3,905,768 | 9/1975 | Hach | 422/100 |
| 4,101,283 | 7/1978 | Sundstrom | 422/100 |

*Primary Examiner*—William T. Dixson, Jr.
*Attorney, Agent, or Firm*—William P. Keegan

[57] ABSTRACT

An improved disposable pipette tip adapted to nest one within another and having a steeply tapered side wall to minimize the length to volume ratio of the tip. An improved self standing tray for the tip also is disclosed as is a new package for pipette tips.

4 Claims, 11 Drawing Figures

DISPOSABLE PIPETTE TIPS AND TRAYS THEREFOR

This invention relates to disposable pipette tips, and more particularly to pipette tips especially adapted for use with different pipettes having different capacity ranges. The invention further contemplates an improved packaging means for pipette tips.

Disposable pipette tips are widely used in clinical laboratories because of their convenience in obviating the need to clean pipettes after each use when handling non-compatible samples or liquids. The tips are wedge fitted onto mechanical pipettes and the liquid aspirated is drawn only into the disposable tip and does not contact any part of the mechanical pipette, thereby avoiding cross contamination between samples or liquids when such would be a problem. Generally, the tips are designed to be used with a number of pipettes, each having a different designated aspirating capacity. Since it is preferred that the volume capacity of the tip only slightly exceed the volume of the liquid drawn into the tip, smaller volume tips generally will be used with the smaller capacity pipettes. However, a particular size tip will be provided for a range of pipette capacities so that a different size tip is not provided for each pipette capacity. Instead of two size tips, the pipette itself may be designed such that the smaller capacity pipettes are insertable farther into the tip than the larger capacity pipettes. In either case, however, the tip is generally a conically shaped element having a straight tapered interior wall that contacts a similarly shaped end of a pipette.

Disposable pipette tips of varying design are disclosed in the following U.S. Pat. Nos.: Re. 27,637; 3,506,164; 3,646,817; 3,656,351; 3,732,734; 3,757,585; 3,766,784; 3,810,391; and 3,855,867. In general, the pipette tips are simply illustrated without descriptive material indicating the reason for the particular shape of the tip illustrated. Pipette tip packages are disclosed in U.S. Pat. Nos. 3,853,217 and 4,130,978.

It is the object of the present invention to provide an improved disposable pipette tip.

It is a further object of the invention to provide an improved tip for use with small capacity pipettes, i.e., pipettes having a one to fifty microliter capacity.

It is still another object of the invention to provide a small volume pipette tip that is relatively short for its volume and is capable of being densely packed.

Another object of the invention is to provide an improved self standing tray for the tip and an improved package therefor.

In carrying out the invention, there is provided a disposable pipette tip having a first tapered segment adapted to accommodate a first size pipette having a first diameter tip end, a second tapered segment adapted to accommodate a smaller capacity pipette having a smaller diameter tip end, a third tapered segment having a sharply tapered wall section, and a fourth segment adapted to serve as a nozzle for axially directing the liquid stream when the contents of the tip are discharged, the second, third, and fourth segments of the tip serving as the fluid reservoir when a first size pipette is used therewith, and the third and fourth segments of the tip serving as the fluid reservoir when a smaller capacity pipette is used. The tip is adapted to nest into another tip and the two tips placed in a self standing tray to provide an especially dense packing of the tips in a tip package.

A feature of the tip is that it has two separate pipette seating surfaces. Another feature of the tip is that it has a nozzle segment provided to form liquid being discharged from the tip into a compact, well defined stream that is axially directed out of the tip. Other features and advantages of the invention may be gained from the foregoing and from the description of a preferred embodiment of the invention which follows.

Figure 2:
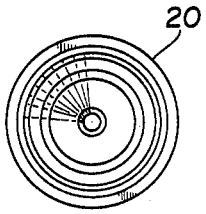
FIG. 2 is an end view of the pipette tip.
Figure 1:
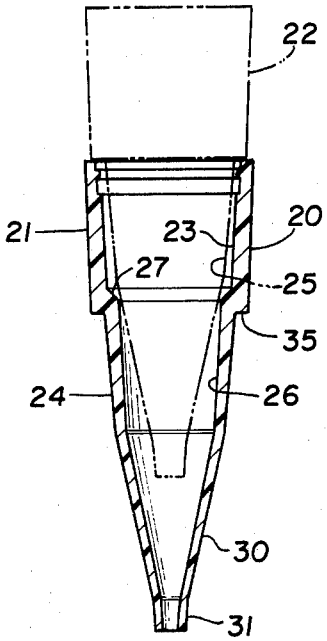
FIG. 1 is a sectional view through a disposable pipette tip of the present invention.

The disposable pipette tip 20 of the invention is shown in FIGS. 1 and 2 of the drawing. The tip is seen to be a generally conical hollow member comprising four segments or sections to which more specific reference now will be made. Upper segment 21 is a tapered conical frustum having an internal surface that is slightly tapered, e.g., a 3° taper. The diameter of the tip is such that a pipette 22 will wedge fit in an air-tight relationship with the internal surface 23 of the tip. The volume capacity of the tip is quite small so pipette 22 will be one capable of aspirating from twenty to fifty microliters. Annular grooves may be provided near the end of tip 20 to form a rim 28 which assures that, during the tip manufacturing procedures, the tip will remain on the core pin of the injection molding apparatus as the pin and the tip are withdrawn from the mold cavity. Thereafter, tip 20 is stripped from the core pin.

A second segment 24 of tip 20, sharply offset from segment 21, is adapted to accommodate a pipette 25 that has a smaller end diameter than pipette 22. The interior surface 26 of segment 24 is tapered approximately 3° so that pipette 25 can be wedge fitted therewith to form an air-tight connection with the tip. Pipette 25, generally, will have a capacity range of one to ten microliters. The sharp transition between surface 23 and surface 26 is made by a bevel 27.

The third segment 30 of tip 20, which serves only as a liquid reservoir, is steeply tapered, e.g., 11°30″, and terminates in the fourth segment 31 of the tip. The fourth segment 31 serves as a nozzle that forms liquid being discharged from the tip into a well defined compact stream directed in an axial direction. Segment 31 is relatively short since it is intended, not to add volumetric capacity to the tip but, to assure a proper formation and direction of the stream of liquid discharged from the tip. The nozzle segment 31 also minimizes the liklihood of a droplet of liquid being formed and retained at the orifice when the contents of the tip are discharged.

The tip configuration disclosed, especially the sharp taper of segment 30, results in a very short tip relative to the maximum diameter of the tip. Thus, for a tip having a maximum outside diameter of just under 0.23 inches, the overall length of the tip will be approximately 0.63 inches and provide a volume capacity up to fifty microliters when a pipette 22 is inserted into segment 21 of the tip.

Figure 3:
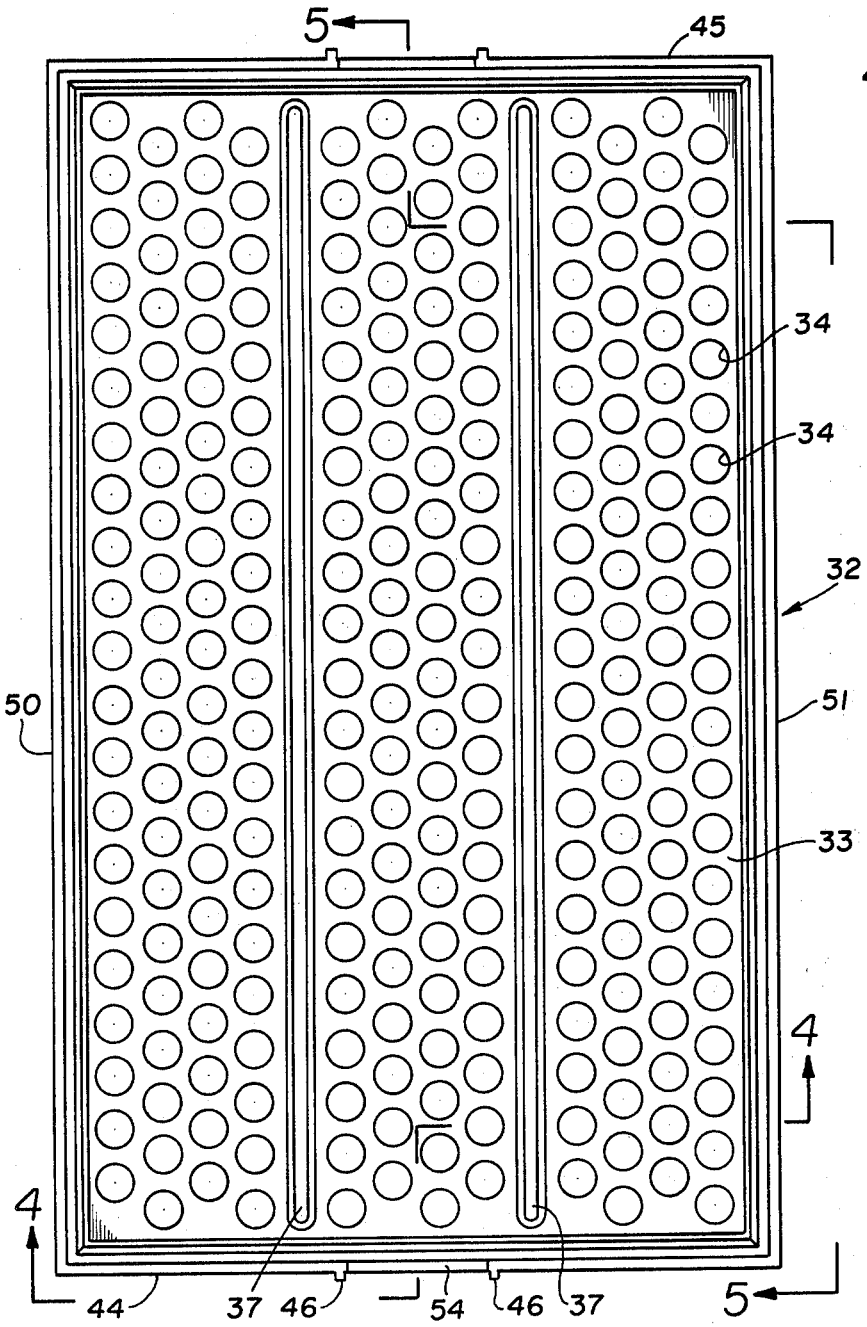
FIG. 3 is a top plan view of a self standing tray for supporting the pipette tip of FIG. 1.
Figure 5:
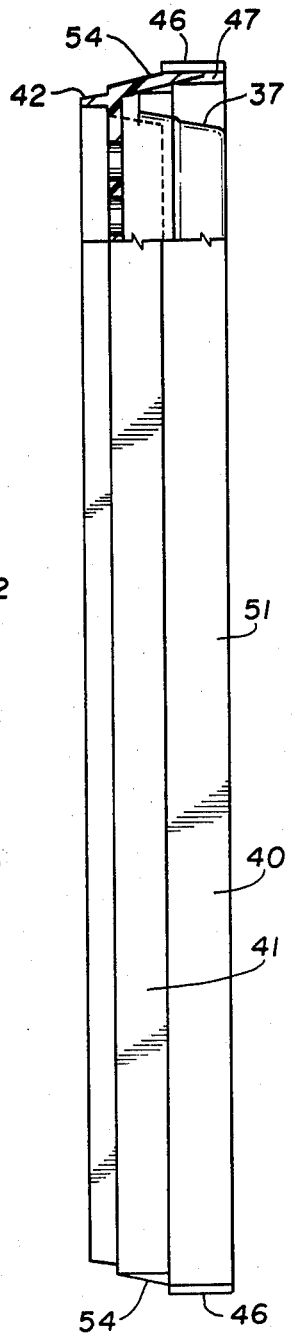
FIG. 5 is a side elevational view, partly in section, taken along line 5—5 of FIG. 3.
Figure 4:
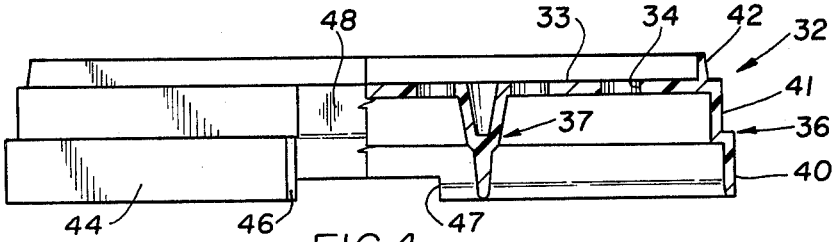
FIG. 4 is an end elevational view, partly in section, taken along line 4—4 of FIG. 3.

Reference is now made to FIGS. 3, 4, and 5 which show a self standing tray 32 into which the aforementioned tips 20 are packaged. The tip supporting surface 33 of tray 32 is provided with a plurality of apertures 34 arranged in a hexagonal or honeycomb layout to permit the densest packing of the tips. The aperture diameter is greater than that of a tip 20 at the point just below the abutment surface 35 but less than that of the abutment. This assures that the tip will be securely supported by tray surface 33 but will loosely project through the aperture to permit easy lifting from the tray surface without any possibility of binding with the tray when a downward pressure is applied to the tip as it is wedge fitted onto a pipette.

The tray 32 is provided with a wall structure 36 that maintains the tip supporting surface 33 a distance above a tray supporting surface, such as a table top, such that a tip supported by the tray and projecting through an aperture thereof does not touch or reach the tray supporting surface. The reason for this is that normally the tips are applied to a pipette by inserting the pipette into a tip while the latter is supported in the tray, and applying sufficient downward pressure to assure an air-tight wedge fit between the pipette and the tip. If the tip touched the tray supporting surface when pressure is being applied to form the air-tight connection between pipette and tip, the nozzle end of the tip could be bent, thus nullifying the benefits of the improved nozzle configuration hereinabove disclosed.

To lend structural rigidity to the tip supporting surface 33 of tray 32, without making the surface so thick (and wasteful of material) as to be inherently rigid, a pair of longitudinal depending ribs 37 are provided on tray 32. The ribs extend downwardly to the plane of the bottom of the tray wall structure 36. In this way, the tray surface 33 can be made thin enough that, without the support provided by ribs 37, the surface would flex when subjected to the pressure incurred when applying a tip to a pipette. Without ribs 37, or equivalent support means, and with a thin flexible tray surface 33 there would be the possibility of the tips being bent at their nozzle ends when being fitted to a pipette as hereinabove described, at least those located near the center of surface 33 where the deflection would be greatest.

Figure 6:
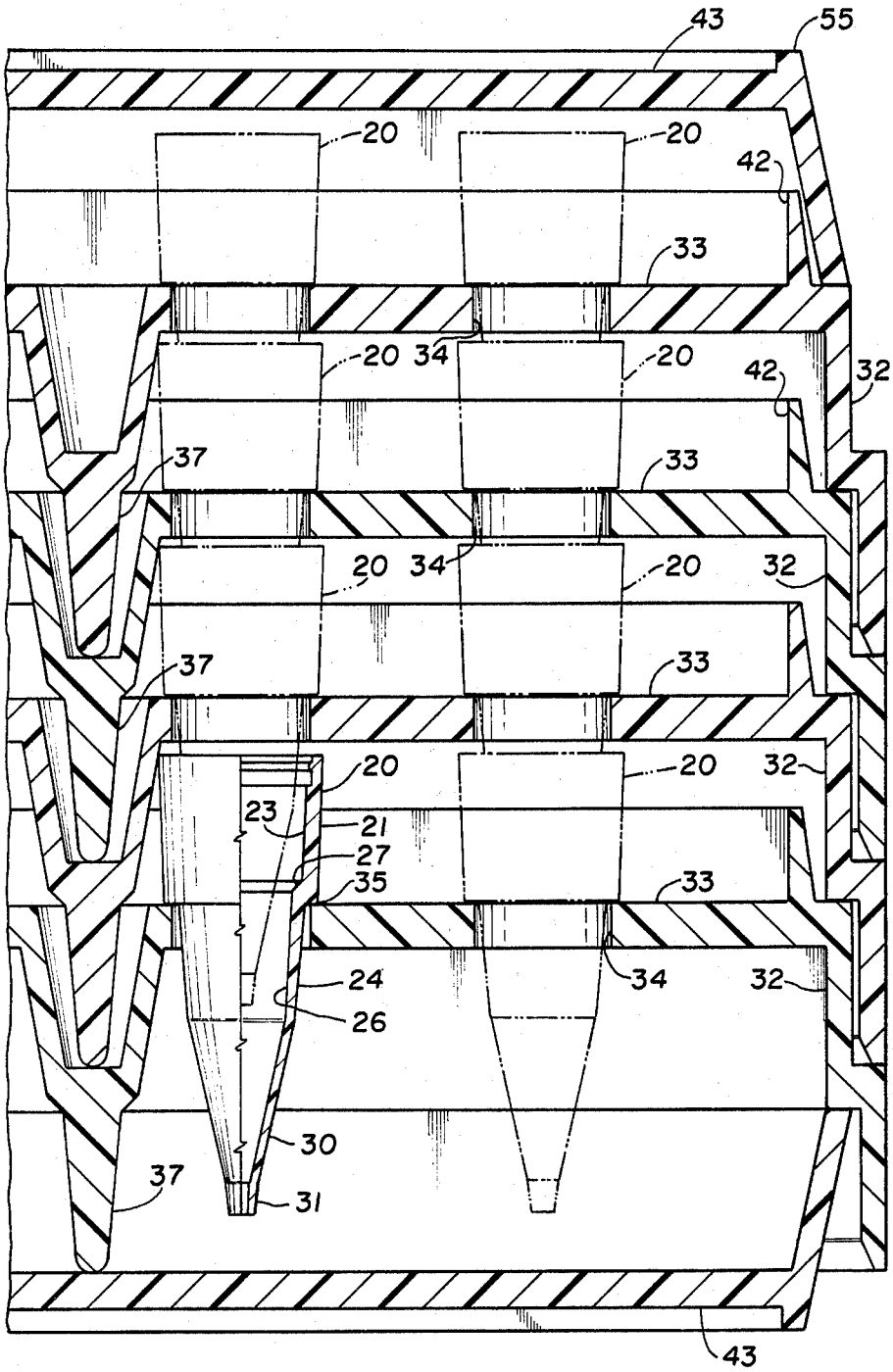
FIG. 6 is a sectional view illustrating a plurality of nesting trays and pipette tips.

In the preferred embodiment being disclosed, the wall structure 36 and the supporting ribs 37 are adapted to enable trays 32 to nest one on another as illustrated in FIG. 6. When the trays nest and the tips supported on the trays also nest, a very compact package of tips and trays can be achieved, especially when tips of the configuration herein disclosed are used.

The wall structure 36 of tray 32 comprises a first section 40 and a second section 41 set back therefrom. The arrangement is such that one tray 32 will nest with a second tray when the peripheral bottom edge of the former rests on the peripheral abutment formed by the setback of the second tray. It should be clearly understood that what has been described is a preferred embodiment of the wall structure and that other equivalent structures will also permit the trays to nest. For example, the bottom of wall section 41 may rest on the top of wall section 40, or ribs or abutments may be formed on the interior surface of an inwardly inclined wall structure and these may rest on the top surface of the wall structure of the tray below. Also, the tray may be formed with corner posts so that the wall structure between the corner posts is raised above the tray supporting surface. In such a construction, the bottom edge of a wall structure would rest on the top edge of the wall structure of a tray below. Setbacks formed in the corners of the wall structure will accommodate the depending corner posts of a tray nested thereon. Other structural arrangements might suggest themselves, but the purpose thereof should be to permit nesting of trays.

It will be noted that the general configuration of supporting ribs 37 is that of the letter "Y". See FIG. 4. With that configuration, the width of the rib can be kept less than or equal to the diameter of an aperture 34, and yet one rib will nest into another when the trays are nested as described. If a different support means is provided other than a rib 37, that support means would be shaped to permit nesting.

Another aspect of the preferred wall structure 36 is the provision of a set back rim 42 which serves to locate a cover member 43 that is provided with a pipette tip package and which will be described hereinafter.

The bottom section 40 of end walls 44 and 45 of tray 32 are each formed with a pair of spaced apart rails 46 that serve to channel a strip of adhesive tape (not shown) which secures a group of nested trays into a single unit comprising a package of trays and tips. A notch 47 formed at the lower edge of each end wall 44 and 45 between a pair of rails 46 facilitates severing the adhesive tape when it is desired to remove one tray of tips from a nest of trays. Of course, while the rails 46 and notches 47 have been described as being in the end walls of wall structure 36, they could just as well have been placed in the side walls 50 and 51. In fact, the rails and notches could be eliminated and an adhesive strip or rubber band applied to a package of trays and tips if the features attributed to rails 46 and notches 47 are foregone.

Another structural feature of tray 32 is the inclined ramp 54 on wall section 41 that extends from the top surface of section 40 between rails 46 to the outer top edge of wall section 41. When trays 32 are nested, the ramps 54 are, except for the uppermost tray, overlaid by the bottom wall sections 40 of the trays nested above. The ramp 54 of the uppermost tray serves as a transition surface for carrying the adhesive strip securing the trays together onto cover member 43.

Figure 7:
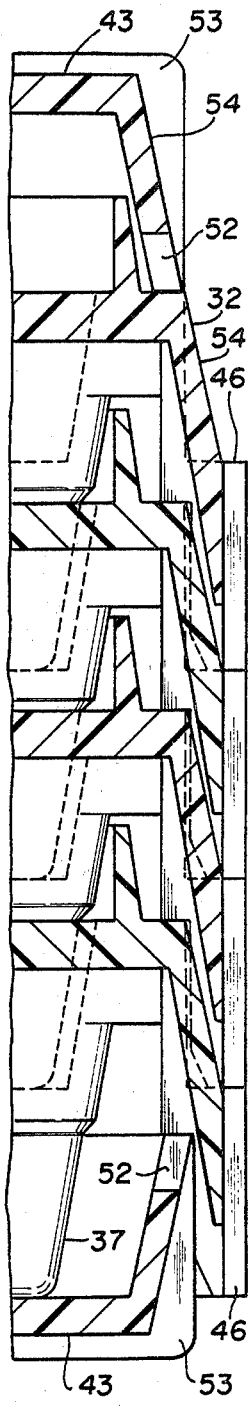
FIG. 7 is a partial sectional view of a plurality of nesting trays showing that part of the tray shown in section in FIG. 5.
Figure 8:
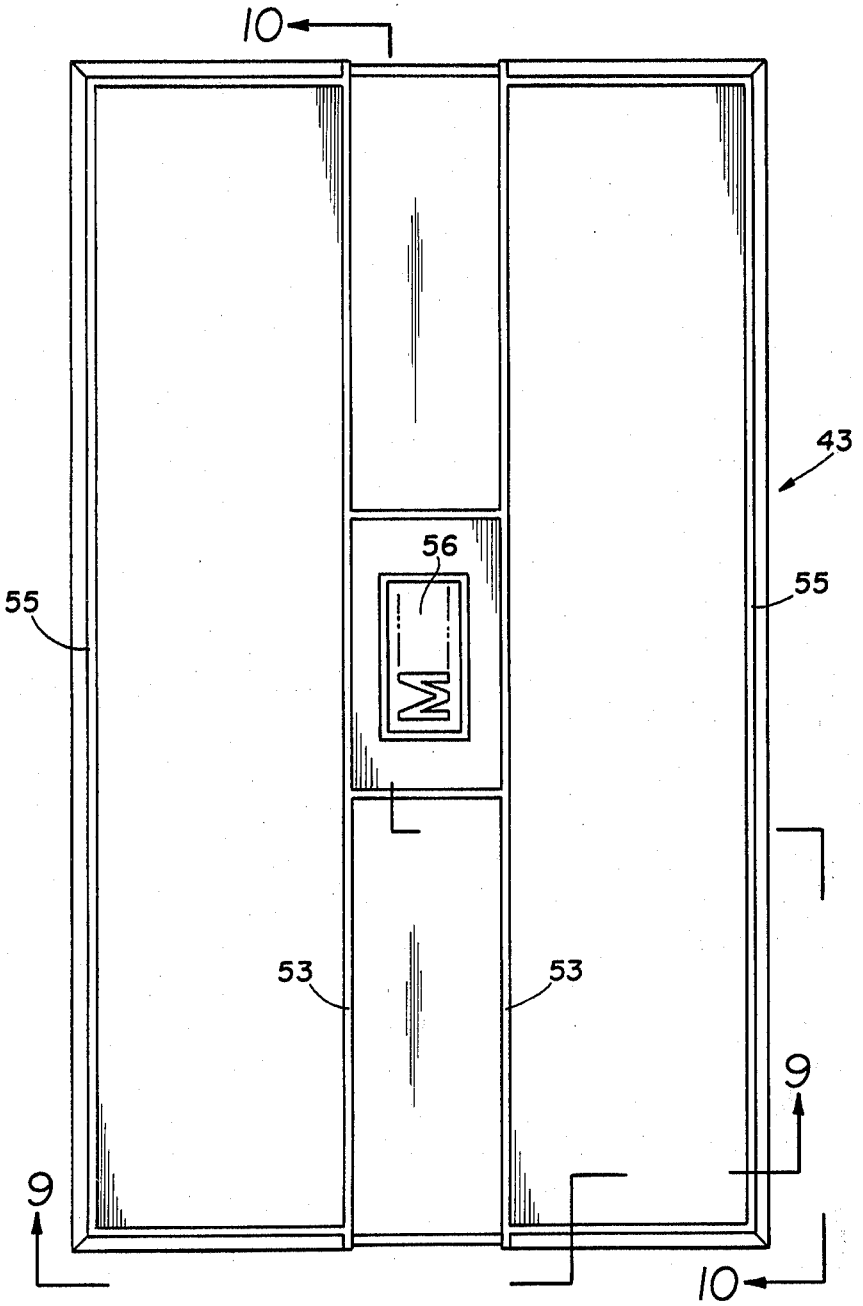
FIG. 8 is a top plan view of a cover member for a tray full of pipette tips.
Figure 10:
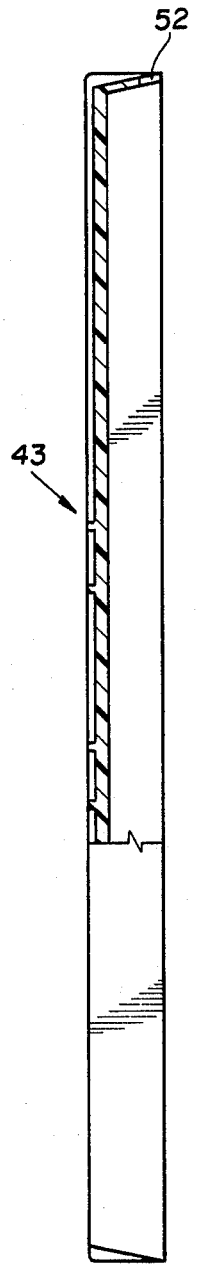
FIG. 10 is a side elevational view, partly in section, taken along line 10—10 of FIG. 8.
Figure 9:
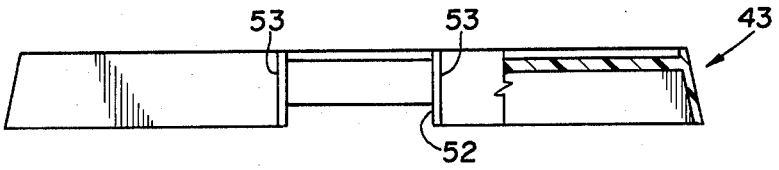
FIG. 9 is an end elevational view, partly in section, taken along line 9—9 of FIG. 8.

Cover member 43, which is shown in FIGS. 8, 9, and 10, is provided to sit on the peripheral top surface of set back wall section 41 with rim 42 serving to prevent transverse movement of the cover with respect to the tray. The cover member 43 also is adapted to close the bottom of a single tray of tips or of a stack of trays and tips as shown in FIGS. 6 and 7. When used as a bottom closure, the inner surface of the top of cover member 43 may engage the bottom of ribs 37, or the bottom edges of the side walls of cover member 43 may engage an abutment formed on the interior surface of wall section 41, or the bottom edge of section 41. Cover member 43 is also provided with a notch 52 to facilitate severing an adhesive strip that might be provided to secure member 43 to a tray 32. Also, guide rails 53 may be provided to channel the adhesive strip along a fixed path over member 43. For aesthetic reasons, the top surface of cover member 43 may be slightly recessed so that a rim 55 is formed that will be contiguous with guide rails 53. A corporate logo 56 may be formed in the central part of the top of member 43.

Figure 11:
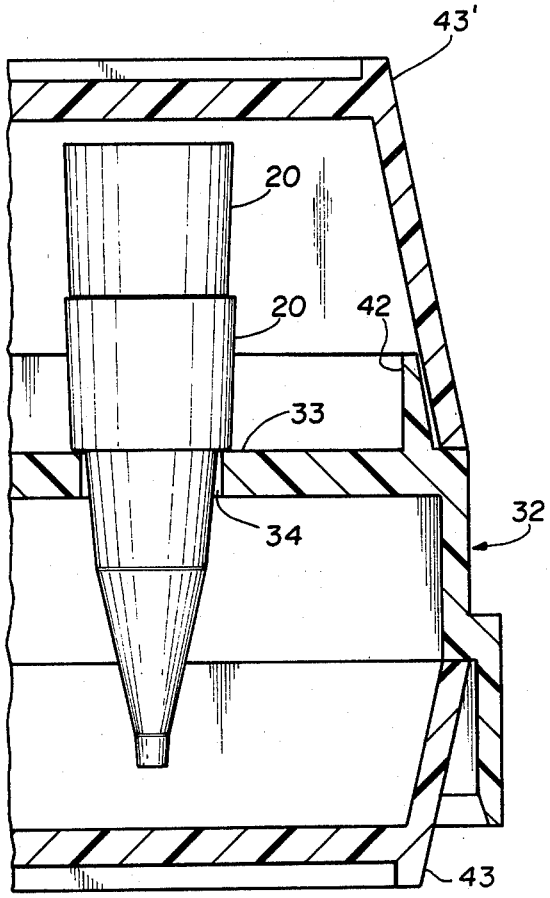
FIG. 11 is a partial sectional view showing a package of disposable pipette tips.

While the pipette tips 20 have been illustrated as being packed one layer deep on a tray 32 and the trays nested (FIGS. 6 and 7), the construction of tip 20 particularly lends itself to being packed at least two deep on a single tray. In such an embodiment, see FIG. 11, one pipette tip 20 is nested into another tip 20 and the two tips supported on a tray 32. This arrangement is particularly suitable when a tip package is to consist of a single tray of tips. If such a package is to be provided with a cover member, the cover member will be similar to cover member 43, but with longer side walls. The bottom closure for such a package could be identical to cover member 43 since the projection of tip 20 through aperture 34 in tray 32 is the same as when a single layer of tips is packed on a tray.

If a plurality of trays are to be nested, each of which contains at least two layers of tips 20, such trays would be similar to trays 32 except that the wall structure of at least those trays above the bottom tray would be lengthened.

Having thus described the invention, it is to be understood that many apparently different embodiments thereof can be conceived without departing from the spirit and scope thereof, and, therefore, it is intended that the foregoing description and the accompanying drawing be interpreted as illustrative rather than in a limiting sense.

What is claimed is:

1. A pipette tip comprising a first segment having a tapered internal surface adapted to accommodate the tapered end of a pipette; a second segment having a tapered internal surface adapted to accommodate the tapered end of a pipette, said surface having a diameter less than that of said first segment and a taper substantially the same as that of said first segment, the internal surfaces of said first and second segments being joined by a shoulder-like bevel; a third segment having a tapered internal surface the taper of which is substantially greater than that of the internal surface of said second segment, the internal surface of said second segment being joined to that of said third segment by the intersection of their tapers; and a tip segment having an internal surface that is tapered at an angle substantially less than that of said third segment and joined to the internal surface of said third segment by the intersection of their tapers, said tip segment serving as a nozzle to form and direct a liquid stream being discharged from the tip, and wherein said third segment serves as a reservoir when a liquid is aspirated by a pipette placed in said second segment, and said second and third segments serve as a reservoir when a liquid is aspirated by a pipette placed in said first segment.

2. A pipette tip according to claim 1 wherein the taper of said third segment is at least twice that of said second segment.

3. A pipette tip according to claim 1 wherein the taper of said third segment is approximately eleven degrees and that of said first and second segments is approximately three degrees.

4. A pipette tip package comprising a plurality of disposable pipette tips according to claim 1, and an apertured self standing tray, wherein each tip has abutment means for supporting the tip on said tray, said pipette tips being arranged such that a first layer of tips projects through the apertures of said tray to be supported thereon by their abutment means, and a second layer of tips is nested into said first layer of tips to be supported thereon by their abutment means.

* * * * *